US007632136B2

(12) United States Patent
Hemmi et al.

(10) Patent No.: US 7,632,136 B2
(45) Date of Patent: Dec. 15, 2009

(54) CONNECTOR CONNECTION TERMINALS

(75) Inventors: Yoshinobu Hemmi, Kawasaki (JP); Hirotada Teranishi, Kawasaki (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/343,189

(22) Filed: Dec. 23, 2008

(65) Prior Publication Data

US 2009/0170352 A1 Jul. 2, 2009

(30) Foreign Application Priority Data

Dec. 28, 2007 (JP) ..... 2007-339706

(51) Int. Cl.
*H01R 12/24* (2006.01)

(52) U.S. Cl. ..... 439/495

(58) Field of Classification Search ..... 439/495, 439/260

See application file for complete search history.

(56) References Cited

U.S. PATENT DOCUMENTS 7,172,446 B1 * 2/2007 Hashimoto et al. ..... 439/260

7,300,304 B1 * 11/2007 Takashita et al. ..... 439/495

FOREIGN PATENT DOCUMENTS

JP 2004-178959 6/2004

OTHER PUBLICATIONS

Patent Abstracts of Japan, Publication No. 2004-178959, dated Jun. 24, 2004, 8 pages.

* cited by examiner

*Primary Examiner*—Phuong K Dinh
(74) *Attorney, Agent, or Firm*—Osha • Liang LLP

(57) ABSTRACT

A connector connection terminal that is less likely to buckle and in which cutting task is facilitated is provided. The present invention provides a connector connection terminal in which substantial height dimension from a rotation recess to an end face at an end on a rear surface side is set larger than a substantial height dimension from the rotation recess to an end face at an end on the front surface side, and an upper surface from the rotation recess to the end face at the end on the rear surface side is a flat surface.

3 Claims, 12 Drawing Sheets

CONNECTOR CONNECTION TERMINALS

BACKGROUND OF THE INVENTION

1. Technical Field

The present invention relates to connector connection terminals, in particular, to a connector connection terminal for connecting to a connecting portion arranged at a distal end of a flexible printed circuit board.

2. Related Art

Conventionally, for an FPC connector, for example, an FPC connector removably fitted with a flexible printed circuit board, the connector including required number of contacts having a contacting portion that contacts the flexible printed circuit board on both sides in an up and down direction, and a housing including a fit-in port to be held and fixed with the contact and to be inserted with the flexible printed circuit board, where the contacting portion in the up and down direction of the contact is arranged in a zigzag manner when a contact point with the contact of the flexible printed circuit board is arrayed in a zigzag manner (refer to, for example, Japanese Patent Application Laid-Open No. 2004-178959)

SUMMARY

However, in the above described connector, a distance from a supporting point 32 of a contact 141, which is a connection terminal, to the vicinity of a connecting portion 24 has a substantially even cross-sectional shape and is elongated, as shown in FIG. 4 of Japanese Patent Application Laid-Open No. 2004-178959. Thus, when press-fitting the contact 141 to an insertion hole of a housing 12, buckling tends to easily occur.

The contact 141 is formed through press working with a carrier from a band-shaped thin plate material, and is cut after being press-fitted to the insertion hole of the housing while being connected to the carrier. However, when cutting the connecting portion with the carrier, the connecting portion of the carrier is folded and cut, and thus plastic deformation easily occurs at the periphery of the connecting portion 24, and cutting task becomes troublesome.

In view of the above problem, the present invention aims to provide a connector connection terminal that is less likely to buckle and in which the cutting task is facilitated.

In order to solve the above problem, a connector according to the present invention relates to a connector connection terminal, in which a substantially T-shaped operation piece is arranged in a projecting manner on an upper surface and a rotation recess is formed on the upper surface towards a rear surface side from the operation piece, being press fitted from the rear surface side to a plurality of insertion holes adjacently arranged so as to pass from a front surface to a rear surface of a housing; and in which a first end of the operation piece is driven with an operation lever having both ends rotatably supported on the rear surface side of the housing and being rotatably supported with the rotation recess as a rotation supporting point to pressure-contact a movable contact point positioned on a second end of the operation piece to a connecting portion of a flexible printed circuit board inserted from the front surface of the housing; wherein a substantial height dimension from the rotation recess to an end face at an end on the rear surface side is set larger than a substantial height dimension from the rotation recess to an end face at an end on the front surface side, and an upper surface from the rotation recess to the end face at the end on the rear surface side is a flat surface.

According to the present invention, the substantial height dimension from the rotation recess to the end face at the end on the rear surface side is set larger than a substantial height dimension from the rotation recess to the end face at the end on the front surface side. Thus, a large geometric moment becomes large and buckling is less likely to occur, and furthermore, plastic deformation is less likely to occur in the cutting task from the carrier.

Furthermore, since an upper surface from the rotation recess to the end face at the end on the rear surface side is a flat surface, the assembly task of the operation lever is facilitated.

According to an embodiment of the present invention, a locking nail that is locked to an edge of the housing may be arranged in a projecting manner at a lower surface positioned between the rotation recess and the end face at the end on the rear surface side.

According to the embodiment, the positioning with respect to the housing is facilitated and is more accurate, and the assembly accuracy is enhanced.

DETAILED DESCRIPTION

An embodiment of the present invention will be described according to the accompanied drawings of FIGS. 1 to 12.

Figure 1:
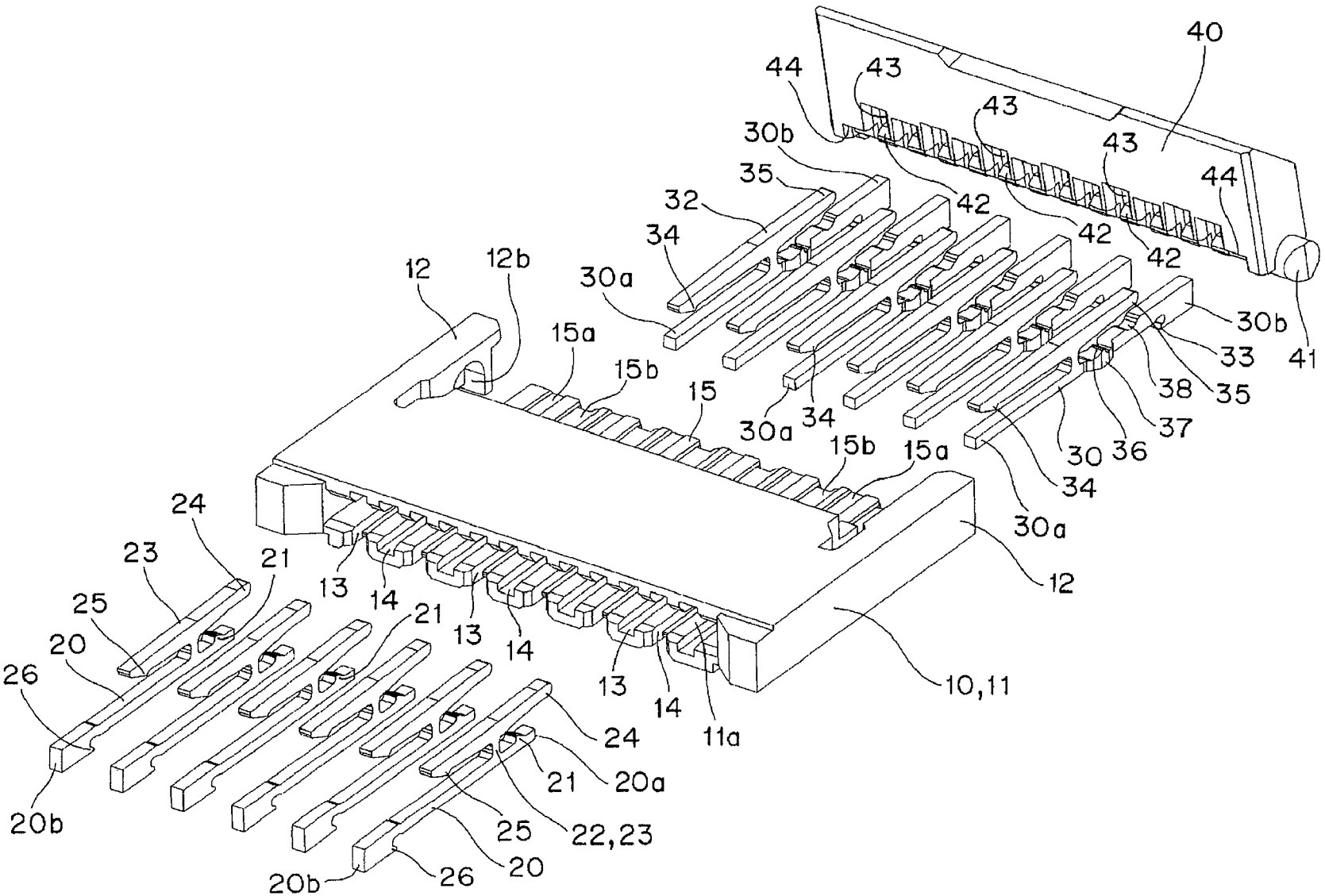
FIG. 1 shows an exploded perspective view showing an embodiment of a connector according to the present invention.
Figure 2A:
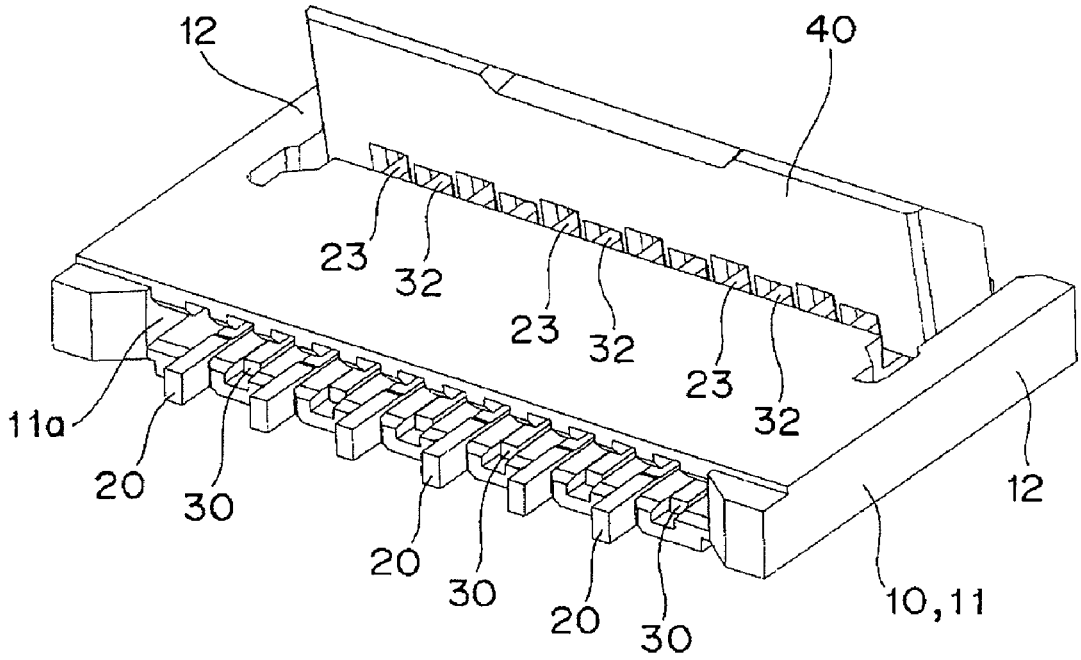
FIGS. 2A and 2B show perspective views seen from one side showing before and after the operation of the connector shown in FIG. 1.
Figure 2B:
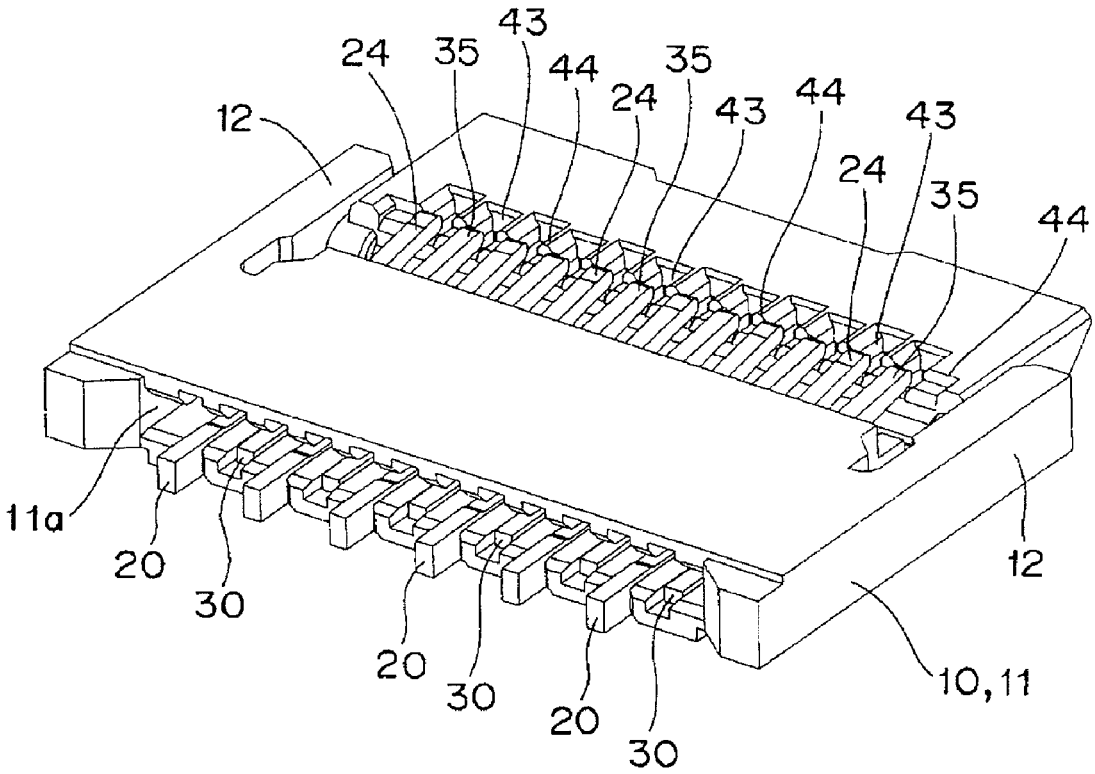
Figure 3A:
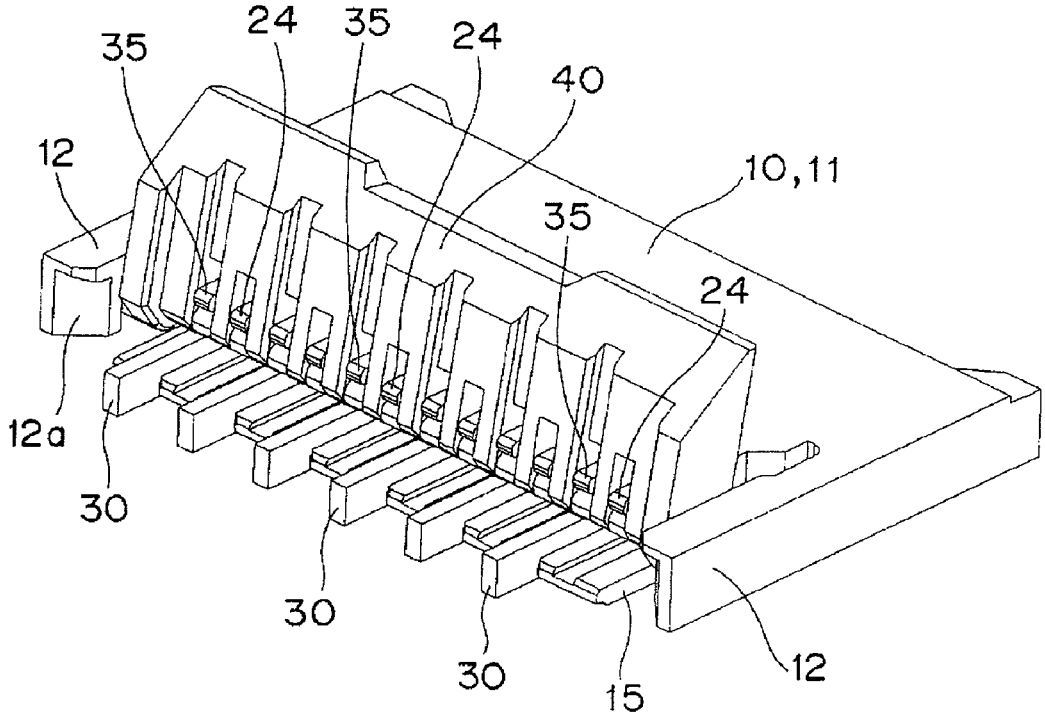
FIGS. 3A and 3B show perspective views seen from the other side showing before and after the operation of the connector shown in FIG. 1.
Figure 3B:
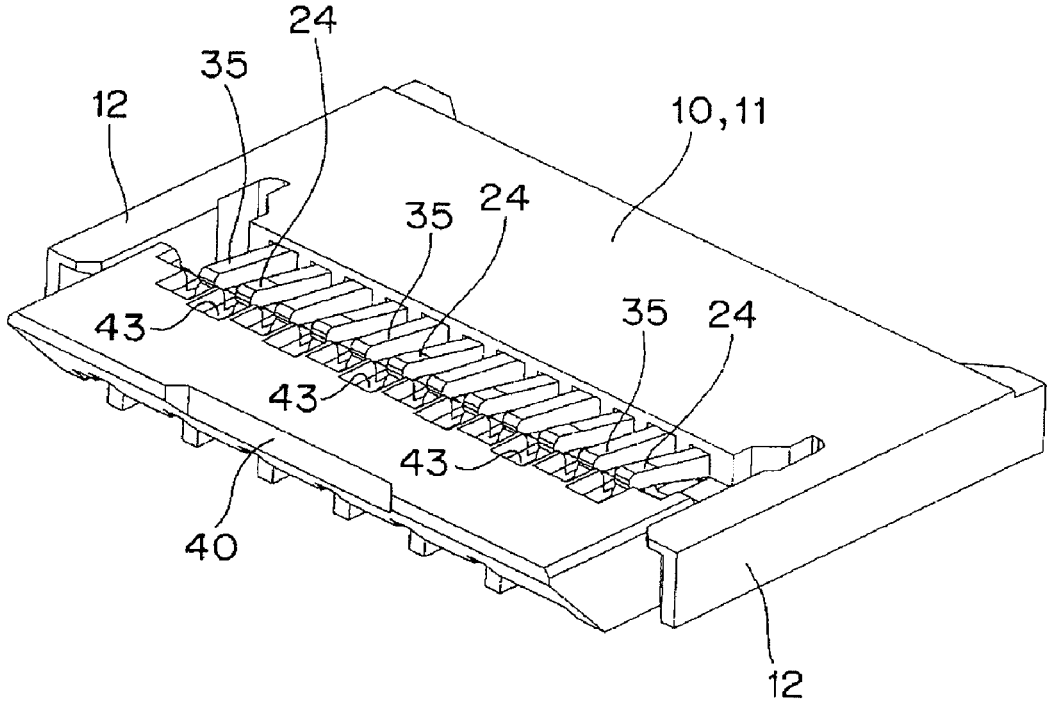
Figure 4A:
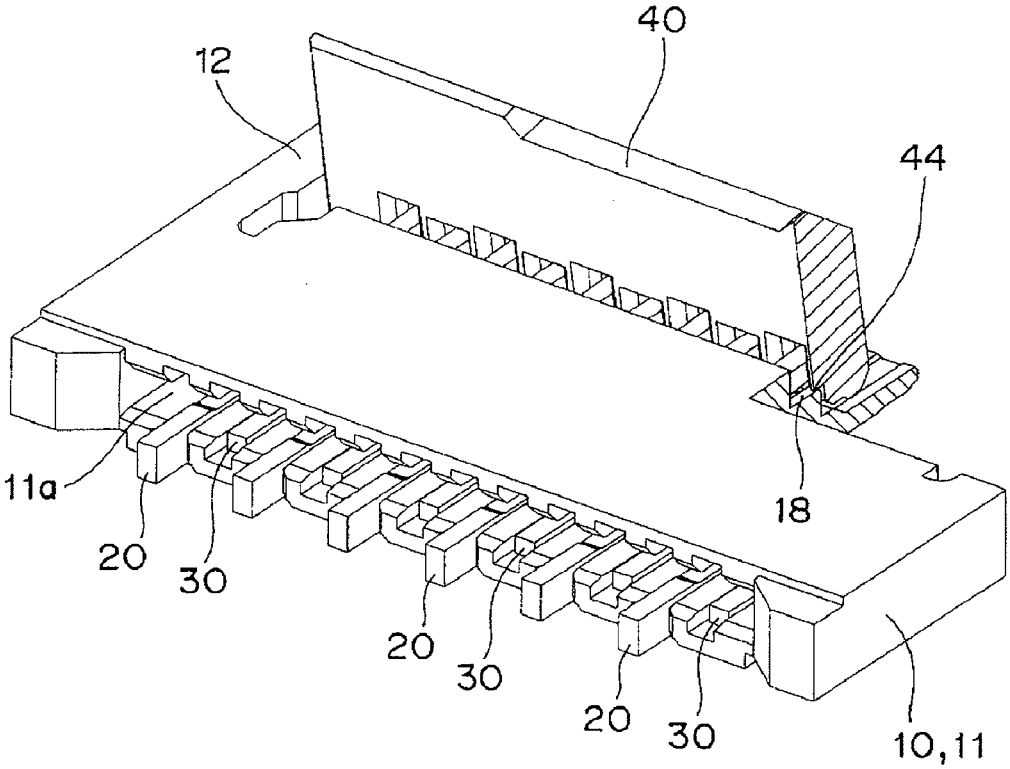
FIGS. 4A and 4B show partially broken perspective views of FIGS. 2A and 3A.
Figure 4B:
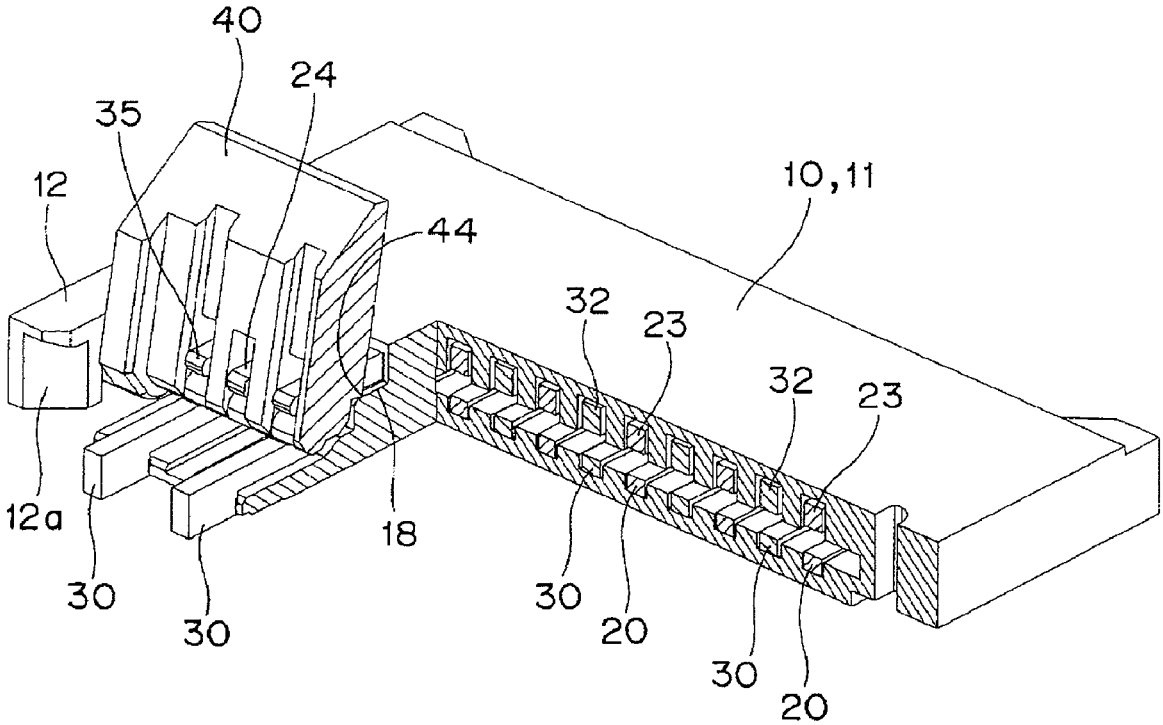

As shown in FIG. 1, a connector 10 according to a first embodiment roughly includes a base 11, a first connection terminal 20, a second connection terminal 30, and an operation lever 40.

Figure 9A:
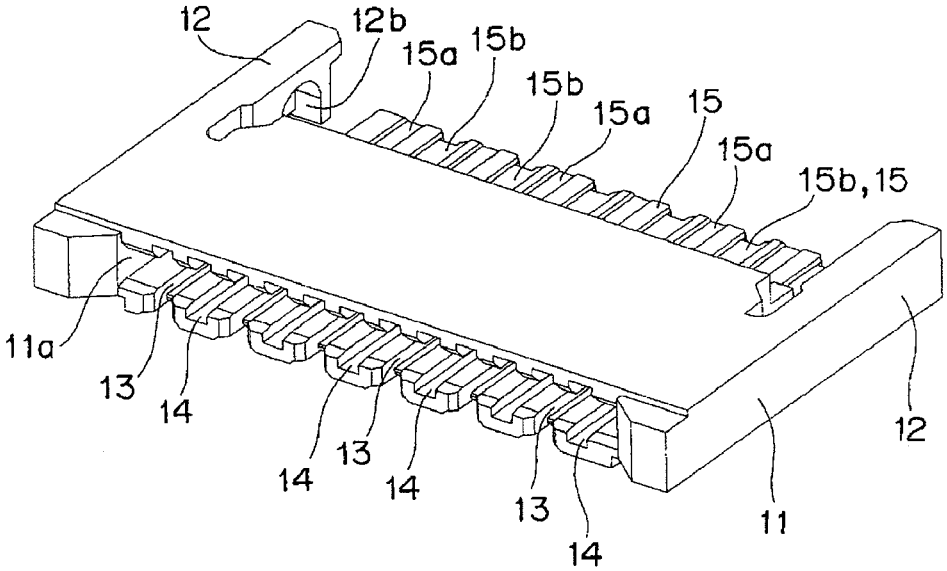
FIGS. 9A and 9B show perspective views seen from different angles of a housing shown in FIG. 1, and FIG. 9C show a partially enlarged perspective view of the housing.
Figure 9B:
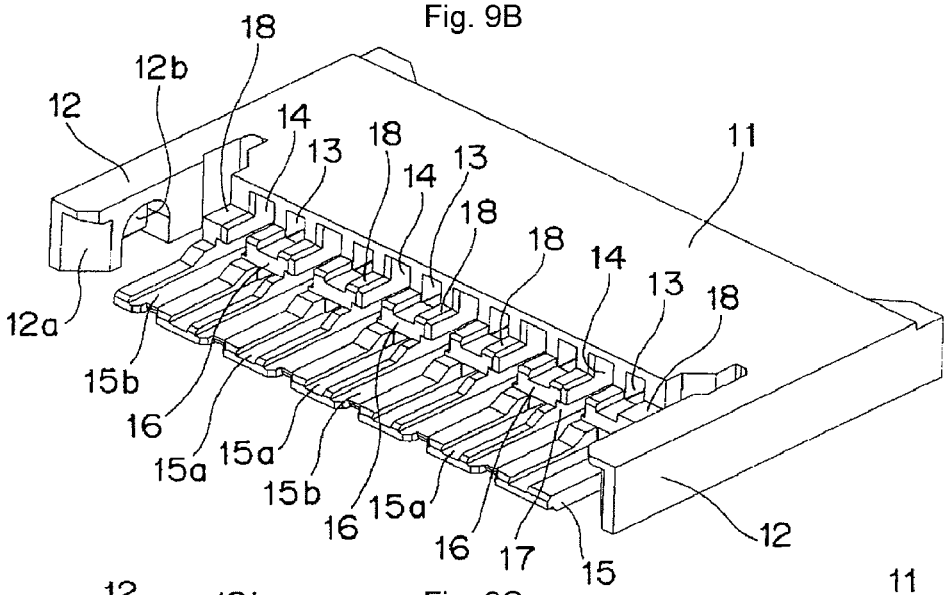

As shown in FIGS. 9A and 9B, the base 11 has elastic arms 12, 12 extending in parallel at a rear surface side from one side edge on both side end faces. Of an inward surface of the elastic arm 12, a guide tapered surface 12*a* is formed at a distal end edge, and a bearing slit 12*b* is formed on a far side thereof.

As shown in FIG. 9A, the base 11 includes, on a front surface side, an opening 11*a* to which a distal end 51 of a flexible printed circuit board 50, to be hereinafter described, can be inserted, and has first insertion holes 13 passing from a front surface to a rear surface and being adjacently arranged at a predetermined pitch.

Figure 9C:
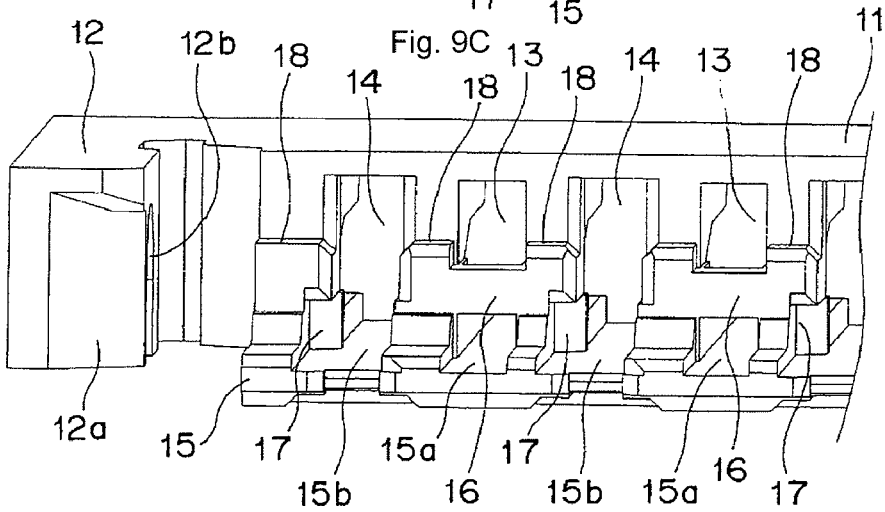

As shown in FIG. 9B, the base 11 has a guide plate 15 extending between the elastic arms 12, 12 from a lower edge at the rear surface, and has second insertion holes 14 adjacently arranged so as to be positioned between the first insertion holes 13. In particular, as shown in FIG. 9C, a slip-out preventing portion 16 is formed on the first insertion hole 13 so as to be bridged over. A slip-out preventing recess 17 is formed on an inner side surface of the second insertion hole 14. Furthermore, discontinuous position regulating surfaces 18 for regulating the position of the operation lever 40, to be hereinafter described, are formed at both ends of the upper surface of the slip-out preventing portion 16, and the like.

The base 11 has guide grooves 15*a*, 15*b* communicating to the first and the second insertion holes 13, 14, respectively, alternately arranged side by side at a predetermined pitch on the upper surface of the guide plate 15.

Figure 10A:
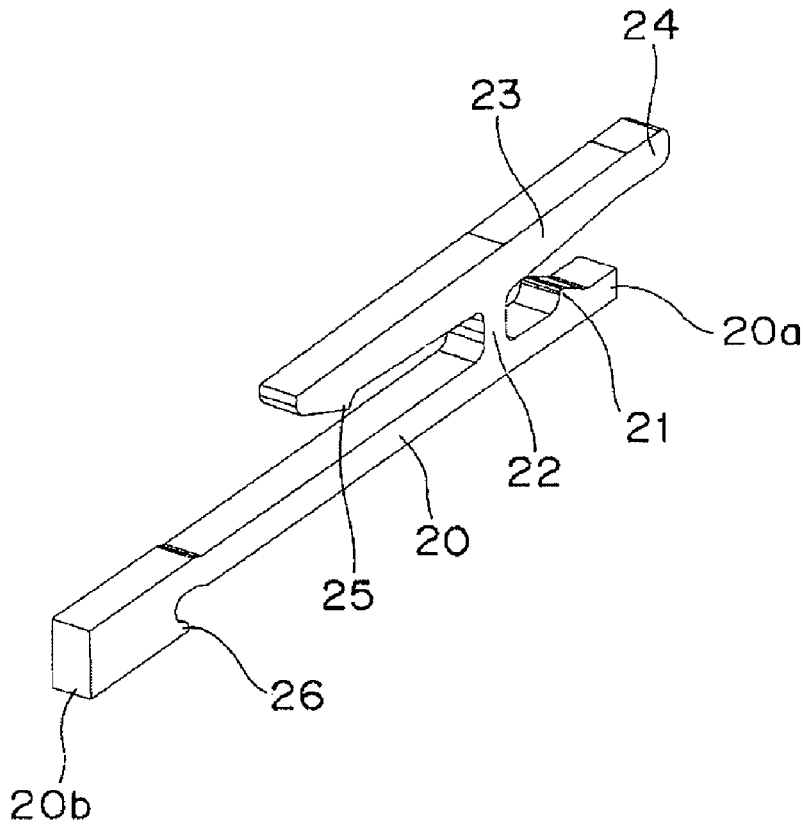
FIGS. 10A and 10B show perspective views seen from different angles of the first connection terminal shown in FIG. 1.
Figure 10B:
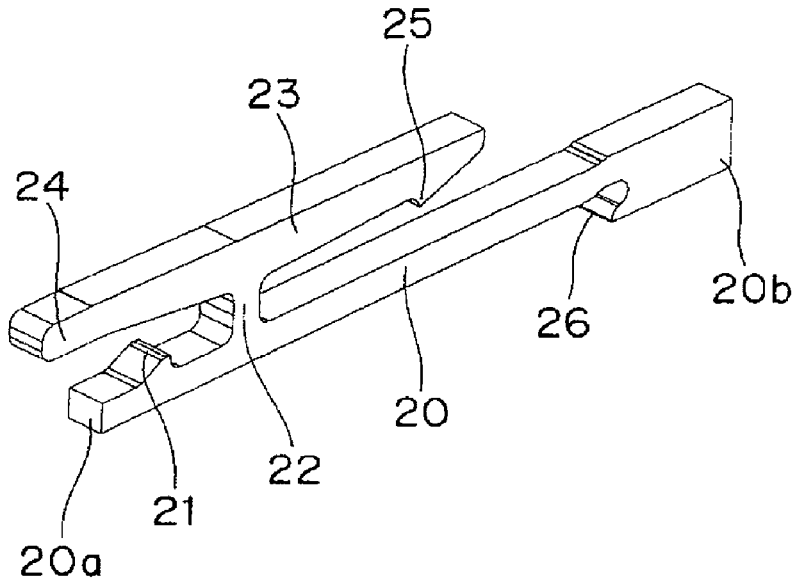

As shown in FIGS. 10A and 10B, the first connection terminal 20 has a slip-out preventing projection 21 formed in the vicinity of a first end 20*a* to be inserted to the first insertion hole 13 of the base 11, and a substantially T-shaped operation piece 23 with a support 22 arranged in a projecting manner at the vicinity of the slip-out preventing projection 21. The operation piece 23 has a first end serving as an operation receiving portion 24 and has a first movable contacting point 25 projecting to the lower side arranged at a second end. The first connection terminal 20 has a lock nail 26 that is locked to the edge of the base 11 arranged on the lower side of a second end 20*b* thereof.

As shown in FIGS. 11A to 11D, the second connection terminal 30 has a first end 30*a* that can be inserted to the second insertion hole 14 of the base 11, a substantially T-shaped operation piece 32 with a support 31 arranged in a projecting manner from an intermediate part, and a lock nail 33 arranged at a lower edge of a second end 30*b*. A first end of the operation piece 32 is arranged with a second movable contacting point 34 projecting to the lower side, and a second end thereof is an operation receiving portion 35. Furthermore, the second connection terminal 30 is arranged with a lock nail 37 in a projecting manner at a protrusion 36 formed by projecting a base of the operation piece 32 to the side. A rotation recess 38 is formed between the second end 30*b* and the protrusion 36.

Figure 11A:
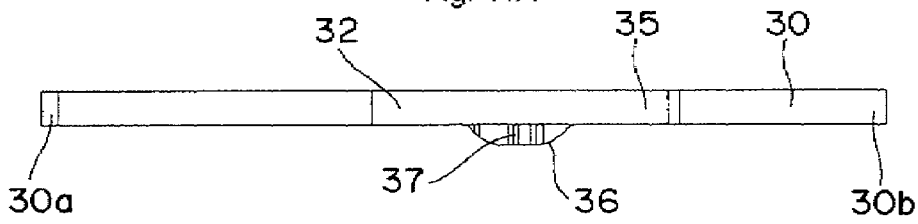
FIGS. 11A and 11B show a plan view and a side view of a second connection terminal shown in FIG. 1, and FIGS. 11C and 11D show perspective views seen from different angles of the second connection terminal.
Figure 11B:
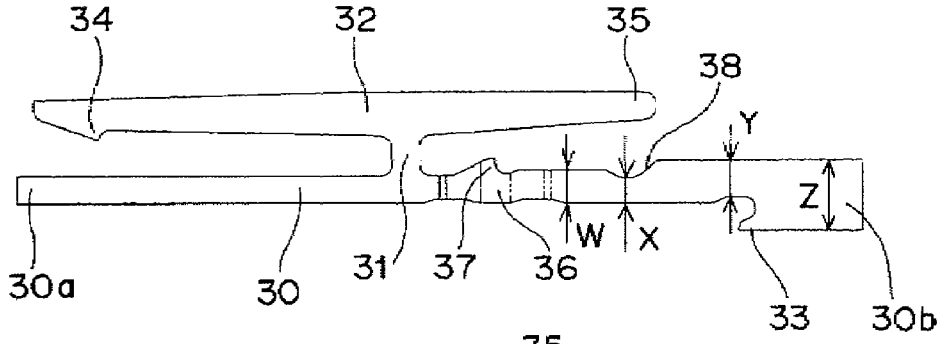
Figure 11C:
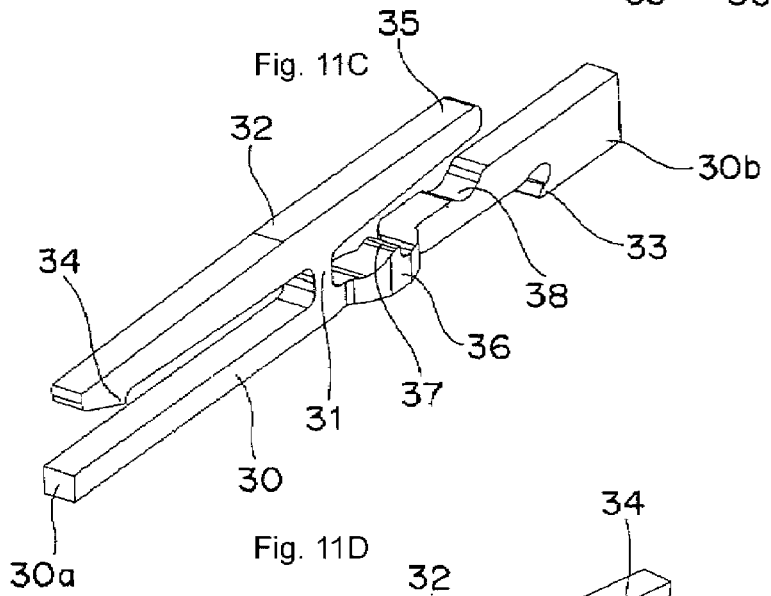
Figure 11D:
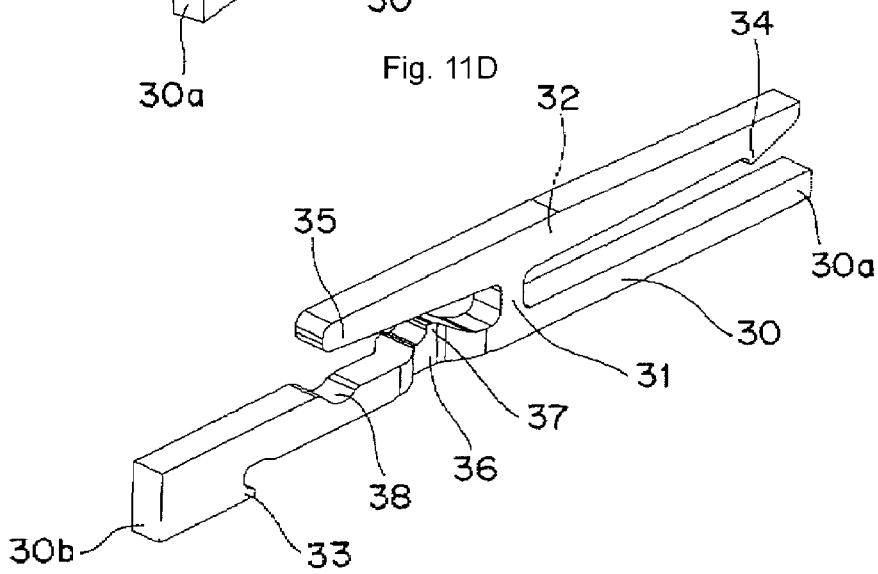
Figure 12A:
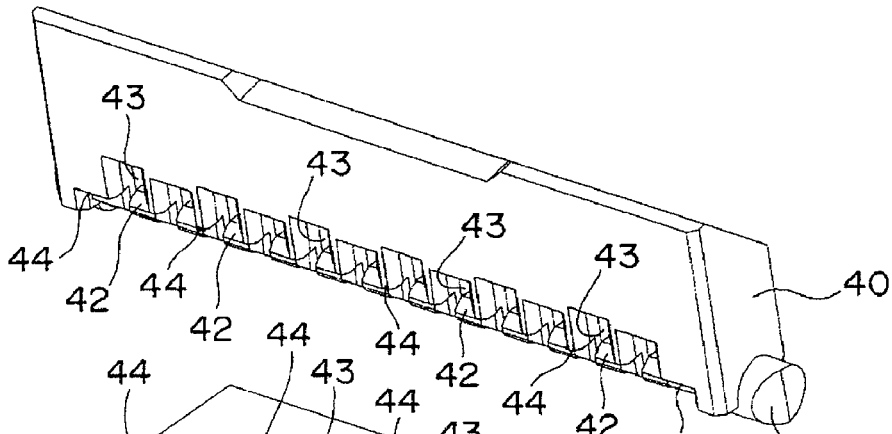
FIGS. 12A, 12B, 12C, and 12D show perspective views seen from different angles of an operation lever shown in FIG. 1.
Figure 12B:
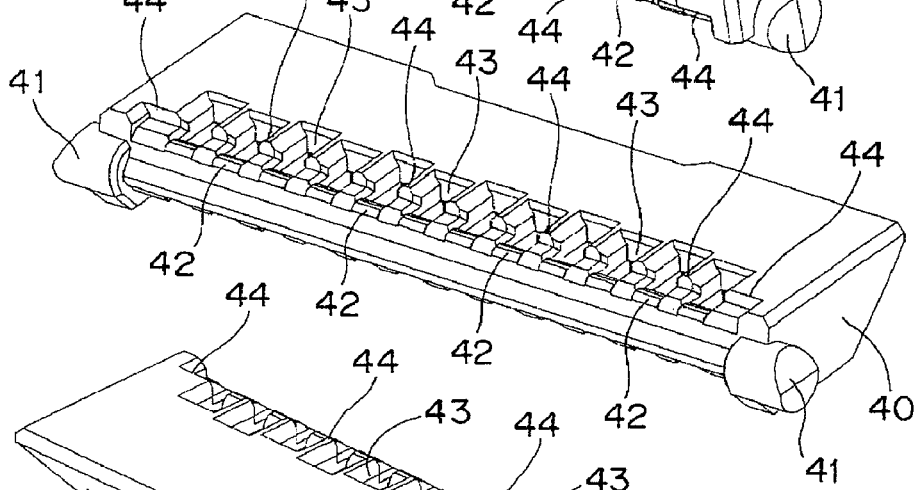
Figure 12C:
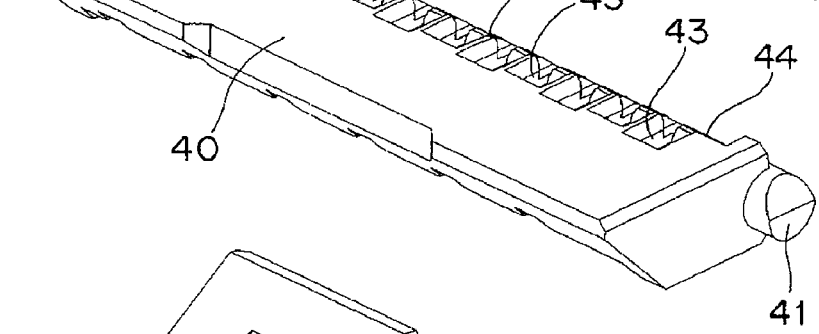
Figure 12D:
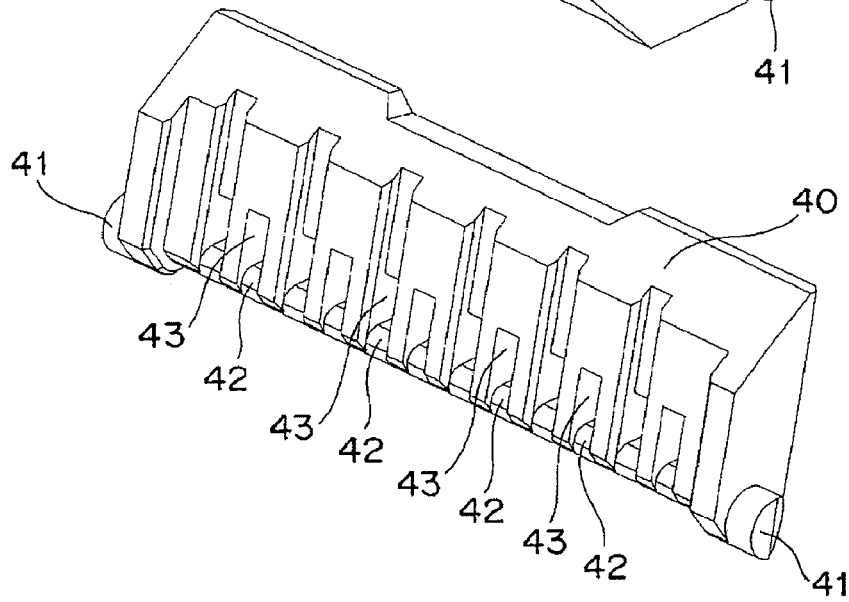

In particular, as shown in FIG. 11B, the second connection terminal 30 has a substantial height Y at the lock nail 33 higher than a substantial height W between the protrusion 36 and the rotation recess 38, and a substantial height X at the rotation recess 38, and furthermore, has a substantial height Z near the end face of the second end 30*b* further increased to enhance the rigidity. Thus, even if the second connection terminal 30 is press fitted to the second insertion hole 14 of the base 11, the second end 30*b* does not buckle and the assembly task can be smoothly carried out. Furthermore, even if the second connection terminal 30 punched out from a lead frame (not shown) is assembled to the housing 11 and then broken off from the connecting portion of the carrier of the lead frame, plastic deformation does not occur at the second end 30*b*, and the yield is satisfactory.

Furthermore, the second connection terminal 30 has the upper surface from the rotation recess 38 to the end face on the second end 30*b* formed as a flat surface. Thus, an advantage in that the assembly of the operation lever 40, to be hereinafter described, is easy is obtained.

As shown in FIGS. 12A to 12D, the operation lever 40 has rotation shafts 41, 41 arranged in a projecting manner on the same axis center at both side end faces. The operation lever 40 has a cam portion 42 for operating the operation receiving portions 24, 35 of the first and the second connection terminals 20, 30 adjacently arranged at a predetermined pitch on one side edge, and a pass through hole 43 to which the operation receiving portion 24, 35 is inserted adjacently arranged at a position corresponding to the cam portion 42. The operation lever 40 also has a contact portion 44 formed so as to ride over the position regulating surface 18 of the base 11 at the vicinity of the pass-through hole 43.

Figure 5:
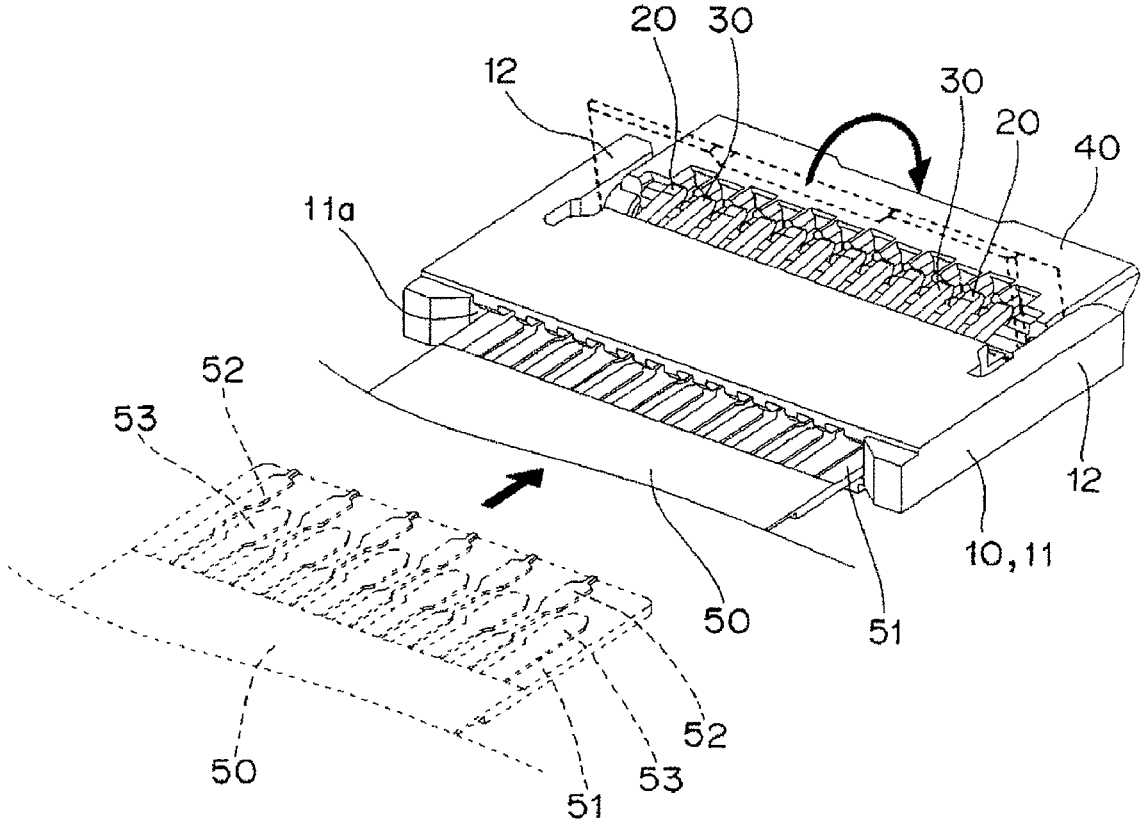
FIG. 5 shows a perspective view describing a method of connecting a flexible printed circuit board to the connector shown in FIG. 1.

As shown in FIG. 5, the flexible printed circuit board 50 connected to the connector 10 according to the present embodiment has first and second connecting portions 52, 53 printed wired on the upper surface of the distal end 51 alternately arranged side by side in a zigzag manner.

A method of assembling the above described components will be described below.

First, the first end 20*a* of the first connection terminal 20 is inserted to the first insertion hole 13 from the front surface side of the base 11. The slip-out preventing projection 21 arranged at the first connection terminal 20 thus is locked to a roof surface of the slip-out preventing portion 16 of the base 11, and the lock nail 26 is locked to the edge of the base 11, to be thereby positioned.

The first end 30*a* of the second connection terminal 30 is then inserted to the second insertion hole 14 along the guide groove 15*b* arranged in the guide plate 15 of the base 11. The protrusion 36 arranged at the intermediate part of the second connection terminal 30 then contacts the slip-out preventing recess 17 of the base 11, and the lock nail 37 locks the slip-out preventing recess 17 while pushing out the same in the up and down direction. At the same time, the lock nail 33 is locked to the edge of the base 11 to be thereby positioned (FIGS. 6 to 8).

In the present embodiment, the second end 30*b* of the second connection terminal 30 has a flat upper surface, a large geometric moment of inertia, and a large rigidity, and thus has an advantage of being less likely to buckle.

The operation receiving portions 24, 35 of the first and the second connection terminals 20, 30 are then respectively inserted to the pass-through holes 43 of the operation lever 40, the operation lever 40 is sled along the upper surface of the second connection terminal 30, and the operation receiving portions 24, 35 are pushed up by the cam portion 42 to be pushed in an elastically deformed state. The cam portion 42 thereby fits into the rotation recess 37 of the second connection terminal 30, the rotation shaft 41 fits into the bearing slit 12*b* of the base 11, and the operation lever 40 is rotatably supported.

Figure 6A:
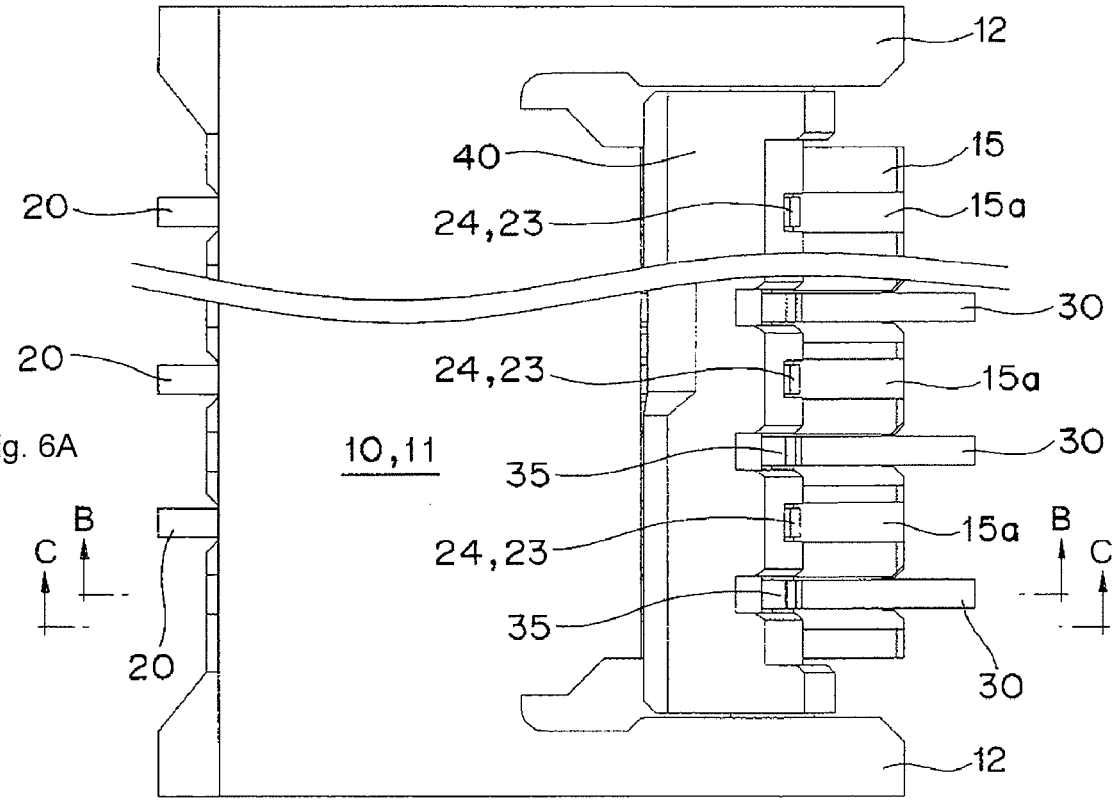
FIG. 6A and FIGS. 6B and 6C show a plan view and partial cross-sectional views describing an operation method of the connector shown in FIG. 1.
Figure 6B:
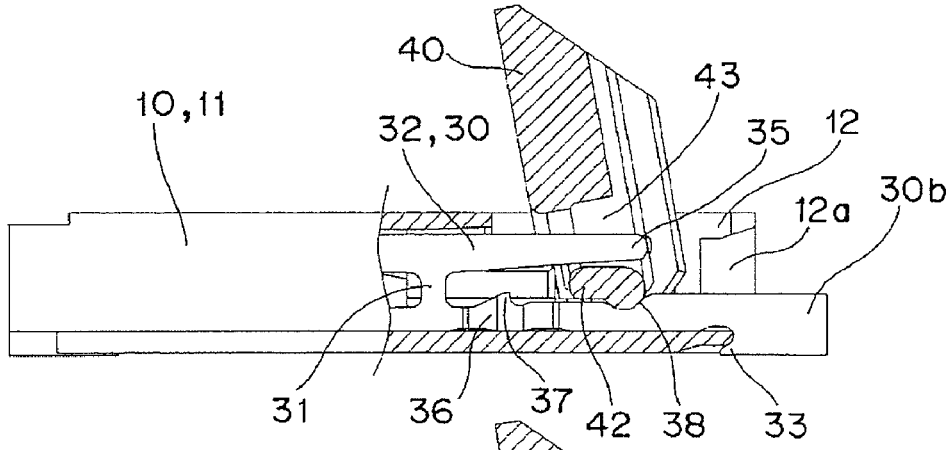
Figure 6C:
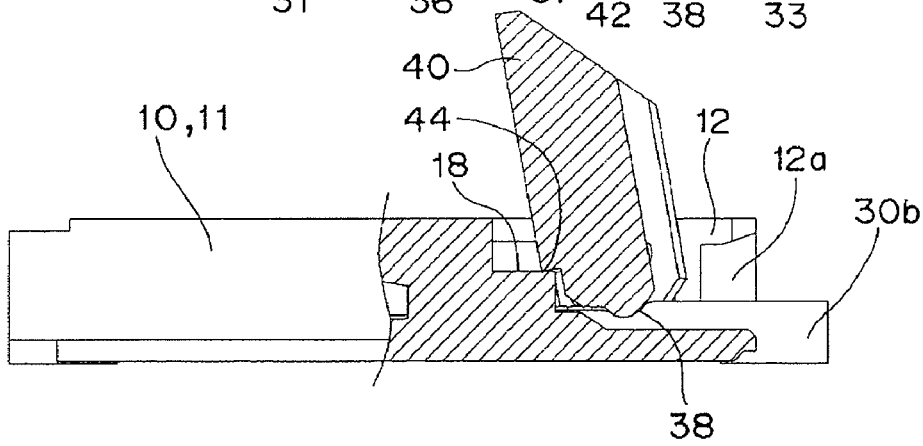
Figure 7A:
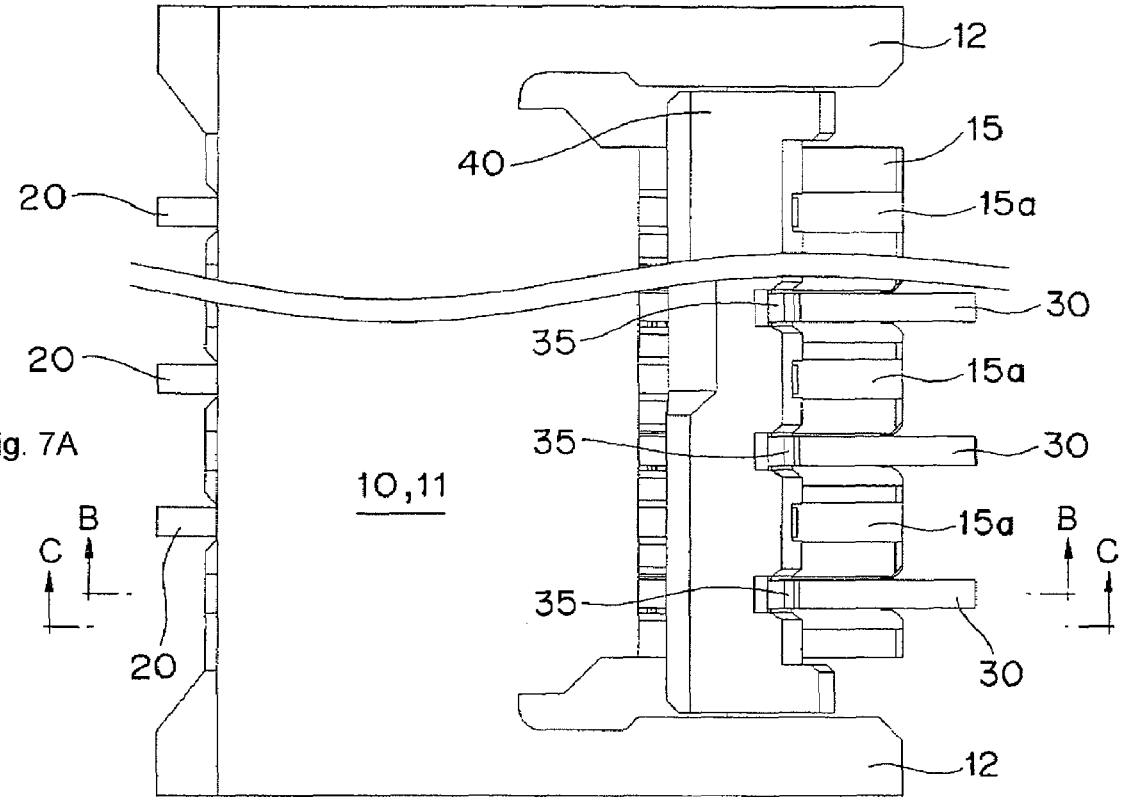
FIG. 7A and FIGS. 7B and 7C show a plan view and partial cross-sectional views describing an operation method of the connector following FIG. 6.
Figure 7B:
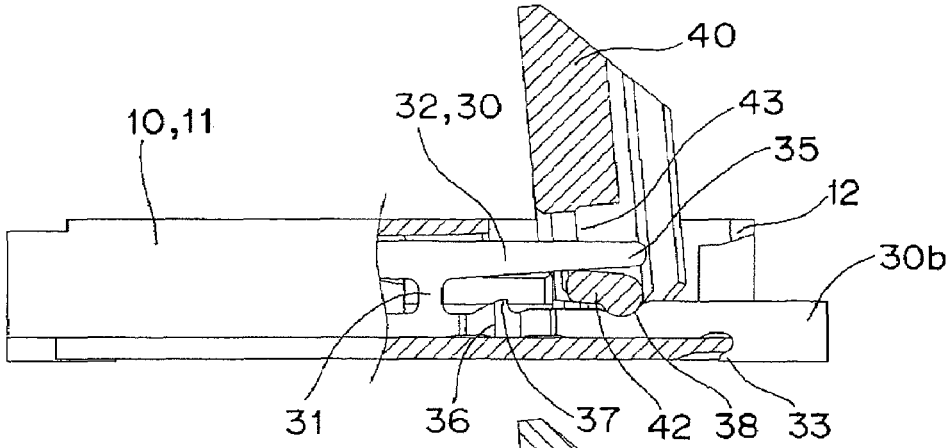
Figure 7C:
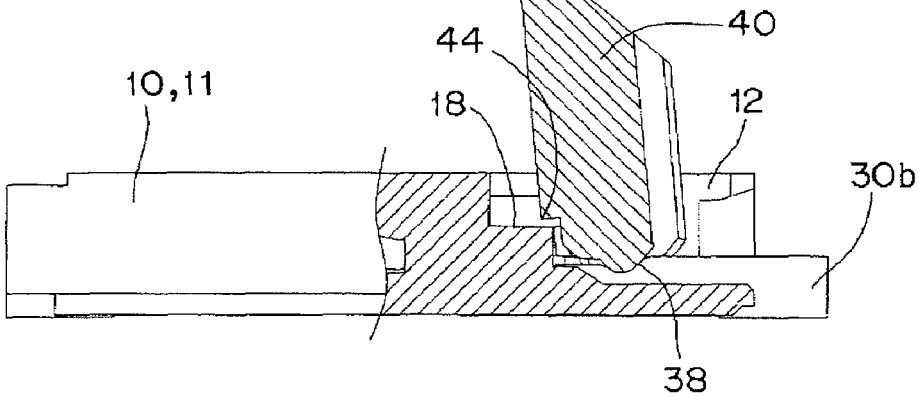
Figure 8A:
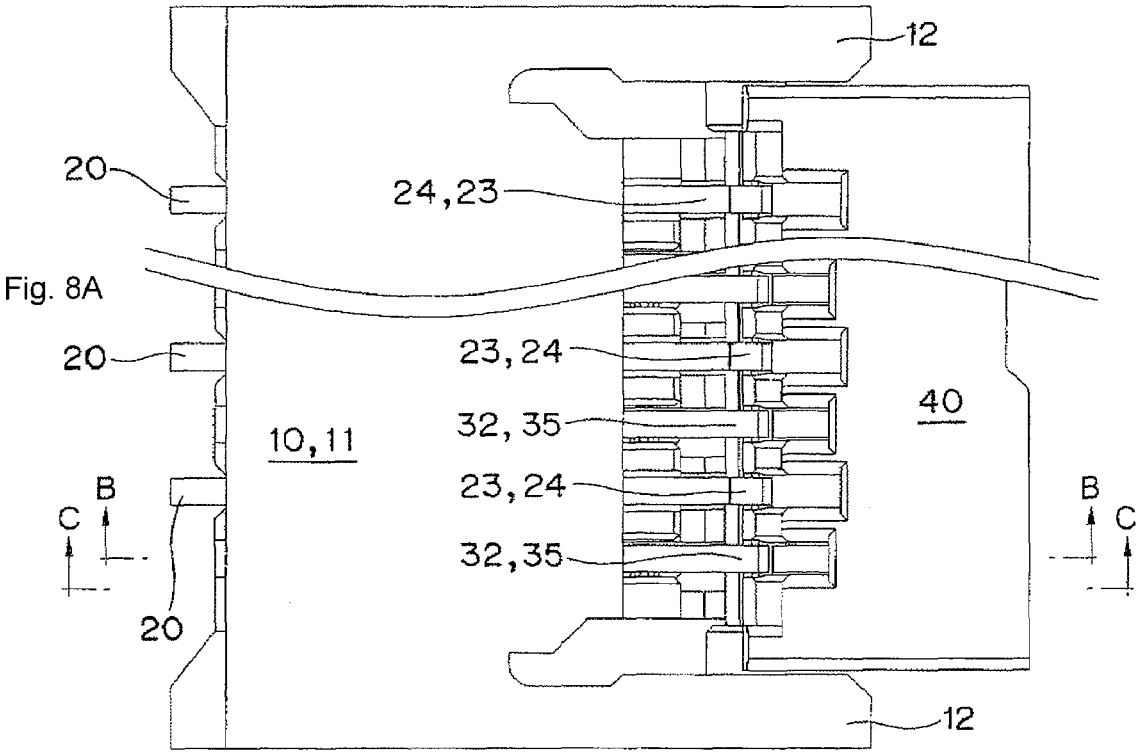
FIG. 8A and FIGS. 8B and 8C show a plan view and partial cross-sectional views describing an operation method of the connector following FIG. 7.
Figure 8B:
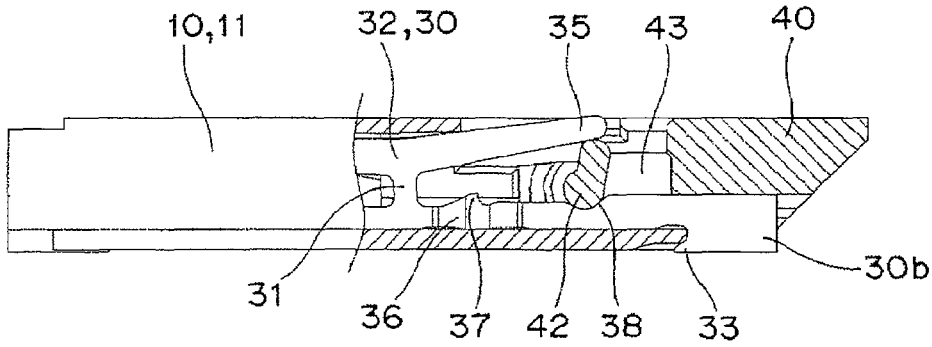
Figure 8C:
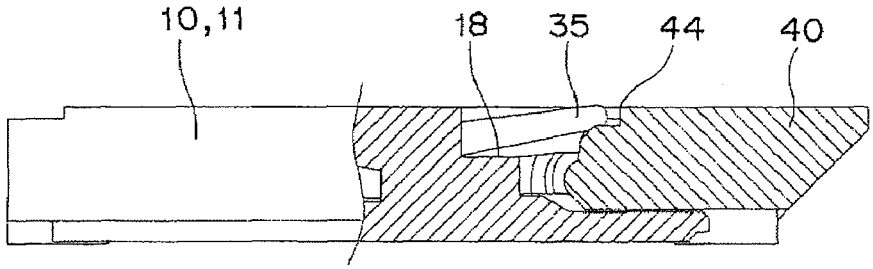

As shown in FIGS. 7 and 6, according to the present embodiment, even if the operation lever 40 is excessively rotated to the opening side, the contact portion 44 formed at the edge of the upper surface of the operation lever 40 rides over the position regulating surface 18 of the base 11 thereby lifting the operation lever 40 upward before the upper surface of the operation lever 40 contacts the edge of the upper surface of the base 11. Thus, the rotation force of the operation lever is greatly divided to the upper side. As a result, the rotation force of the operation lever 40 is less likely to be divided in the horizontal direction, and the second connection terminal 30 is not pushed out from the base 11.

In particular, when transporting the connector 10 over a long distance after the completion of the assembly, the second connection terminal 30 does not slip out from the base 11 even if microscopic vibration is applied on the operation lever 40 and the operation lever 40 repeats microscopic rotation operation.

Furthermore, even if an impact force more than expected, for example, an impact force from dropping of a package container is applied on the connector 10 individually stored in the package container (not shown), the position of the operation lever is always regulated with respect to the base 11, and thus the second connection terminal 30 does not slip out from the base 11.

A method of connecting and fixing the flexible printed circuit board 50 to the connector 10 will now be described based on FIGS. 5 to 8.

As shown in FIG. 5, the distal end 51 of the flexible printed circuit board 50 is inserted to the opening 11*a* of the base 11 until the distal end 51 of the flexible printed circuit board 50 hits an inner side surface of the base 11. The operation lever 40 is then rotated and pushed down with the axis center of the rotation shaft 41 as the center, whereby the cam portion 42 simultaneously pushes up the operation receiving portions 24, 35 of the first and the second connection terminals 20, 30, as shown in FIGS. 7 and 8. The substantially T-shaped operation pieces 23, 32 having the supports 22, 31 as the supporting point then tilts, and each of the first and the second movable contacting points 25, 34 pressure-contacts and conducts to the first and the second connecting portions 52, 53, respectively, arranged at the distal end 51 of the flexible printed circuit board 50.

In the present embodiment, since the cross-section of the cam portion 42 has a substantially elliptical shape, a distinct operation feeling is obtained as the rotation moment suddenly lowers when rotated by a predetermined angle.

When detaching the flexible printed circuit board 50 from the connector 10, the cam portion 42 is inverted by rotating the operation lever 40 in the opposite direction, whereby the bending moment on the operation receiving portions 24, 35 of the first and the second connection terminals 20, 30 is canceled, the connection state of the first and the second movable contacting points 25, 34 with respect to the first and the second connecting portions 52, 53 is released, and thereafter, the flexible printed circuit board 50 is pulled out.

According to the present embodiment, as shown in FIG. 5, since the first and the second connecting portions 52, 53 of the flexible printed circuit board are arranged in a zigzag manner, mounting density is further increased, miniaturization is facilitated, and contact reliability is enhanced.

The contact portion of the operation lever may be an acute angle or an obtuse angle, or may be a round surface. The position regulating surface of the base is not limited to a flat surface, and may be a tapered surface.

Furthermore, the position regulating surface may be formed at the operation lever, and the contact portion may be formed at the base.

The connector 10 according to the present invention is not limited to the connector described above, and is obviously applicable to other connectors.

What is claimed is:

1. A connector connection terminal, comprising:

a main terminal piece comprising a front end, a rear end, and an upper surface;

a substantially T-shaped operation piece projecting from the upper surface of the main terminal piece and comprising a first end and a second end; and a rotation recess formed on the upper surface on a side of the operation piece towards a direction of the rear end, wherein the front end of the main terminal piece and the first end of the operation piece are press fitted into one of a plurality of insertion holes adjacently arranged on a rear side of a housing;

wherein an operation lever has lateral ends thereof rotatably supported by the housing towards a rear end of the housing and is rotatably supported by the rotation recess as a rotation support point;

wherein a second end of the operation piece is driven by operation lever to pressure-contact a movable contact point disposed on a first end of the operation piece to a connecting portion of a flexible printed circuit board inserted from the front side of the housing;

wherein an entirety of the substantial height dimension of the main terminal piece from the rotation recess to the rear end is set larger than a substantial height dimension of the main terminal piece directly in front of the rotation recess, and wherein the upper surface of the main terminal piece from the rotation recess to the rear end is a flat surface substantially parallel to a lower surface of the main terminal piece.

2. The connector connection terminal according to claim 1, wherein a locking nail locked to an edge of the housing projects from a lower surface of the main terminal portion, positioned between the rotation recess and the rear end.

3. The connector connection terminal according to claim 1, further comprising a protrusion formed on the main terminal portion between the rotation recess and the operation piece that protrudes in a lateral direction perpendicular to a height direction and a front-rear direction of the connector connection terminal.

* * * * *